US006688849B2

(12) United States Patent
Keeton

(10) Patent No.: US 6,688,849 B2
(45) Date of Patent: Feb. 10, 2004

(54) IMPELLER AND PROPELLER

(76) Inventor: John P. Keeton, 2635 Vidalia Ter., Colorado Springs, CO (US) 80919

( * ) Notice: Subject to any disclaimer, the term of this patent is extended or adjusted under 35 U.S.C. 154(b) by 0 days.

(21) Appl. No.: 10/156,288

(22) Filed: May 29, 2002

(65) Prior Publication Data

US 2003/0223874 A1 Dec. 4, 2003

(51) Int. Cl.[7] ..... F04D 29/18

(52) U.S. Cl. ..... 416/197 R; 416/223 R; 416/228; 416/243

(58) Field of Search ..... 416/176, 197 R, 416/223 R, 228, 243

(56) References Cited

U.S. PATENT DOCUMENTS 1,080,406 A * 12/1913 Bagley ..... 416/243
1,540,728 A * 6/1925 Weidinger ..... 416/235
1,825,868 A * 10/1931 Hull ..... 416/234
6,247,897 B1 * 6/2001 Patel ..... 416/197 R

* cited by examiner

*Primary Examiner*—Ninh H. Nguyen

(57) ABSTRACT

An improved impeller which facilitates greater linear movement of a media with less torque; and which accordingly, consumes less power. A blade portion of the impeller has a front media accelerating face and substantially varying slopes which increase from the leading to the trailing edge portions of a media-accelerating front face thereof, to facilitate a gradual acceleration of the media as the impeller rotates. The slope of the front face of the blade portion also gradually increases moving outwardly along the intermediate blade portion, from the hub to the peripheral edge portion thereof. The blade portions have increasing slope to accelerate the media more axially, and less radially, as the impeller rotates. The leading and trailing edge portions of the blade portion each have an elongated forwardly extended peripheral portion, which culminates in a tip portion, which is most preferably bulbuous, to facilitate efficient penetration of the media by the blade portion.

18 Claims, 3 Drawing Sheets

IMPELLER AND PROPELLER

FIELD OF THE INVENTION

This invention relates to impellers and agitors used to mix industrial slurries and also used to propel marine vessels. More particularly this invention relates to an impeller having a unique design which facilitates greater linear movement of a media with less torque; and which accordingly, consumes less power, to perform equivalent work.

BACKGROUND OF THE INVENTION

The applicant is a mechanical designer who has worked and experimented with impellers used in mixing. He has extensively varied impeller parameters which are commonly accepted in hopes of producing a more efficient impeller. Many of the variations which he has produced have an empirical appeal as sensible, but none the less, these variations are radical in industries which have been relatively static in impeller designs for long periods.

Efficiency and energy conservation today more than ever are principal concerns, and almost the only concern in the design of impellers for use in any media.

One accepted measure of an impeller's efficiency is the ratio of the flow produced by the impeller divided torqe. A minute variation in an impeller's efficiency on a marine vessel translates into not only thousands of dollars of fuel saved on a single trans-Atlantic voyage, but additionally, more capacity to carry cargo, less wear on the power plant, and reduced maintenance costs. Operational profitability is hugely impacted. The variation of a design parameter which produces a minute improvement in the efficiency of an impeller is highly significant.

OBJECTS OF THE INVENTION

It is an object of this invention to disclose multiple variations in the design of an impeller which individually result in a more efficient impeller. In combination, these variations result in a substantially more efficient impeller. It is an object of this invention to disclose an impeller which has substantially varying slopes which increase from the leading, to the trailing edge of the impeller, and which facilitate a gradual acceleration of the media when the impeller rotates. It is an object of this invention to disclose an impeller which is designed to efficiently penetrate the media as it rotates. The peripheral portion of the spiralled leading edge of the impeller comprises a bulbuous tip which is the first portion of the blade to penetrate the media. This bulbuous tip is fashioned after a bulbuous bow on a ship. It is yet a further object of this invention to disclose an impeller design which is shaped to inwardly accelerate the media as it rotates therein. A blade portion of the impeller increases in slope from its inner to its peripheral edge. The impeller effectively draws the media to its central portion wherein the media is trapped and accelerated parallel to the axis of the impeller. The resulting wake produced by an operating impeller is generally more axially directed than an impeller of conventional design which throws the media more outwardly and whose wake tends to be more outwardly directed. It is a final object of this invention to disclose an impeller having a leading edge which spirals back from the extended bulbuous tip to the central hub thereof.

In an impeller for rotation in a media of the type having a central hub, an inclined blade portion having an inner radial edge portion attached to the central hub, an intermediate blade portion adjoined to the inner radial edge portion on one side, a peripheral edge portion attached to and extending outwardly from the central portion, a leading edge portion, a trailing edge portion, a front face, and a rear face, one aspect of this invention provides for an impeller having the following improvement. The blade portion has a front media-accelerating face and substantially varying slopes which increase from the leading to the trailing edge portions of the media-accelerating front face of the impeller, to facilitate a gradual acceleration of the media as the impeller rotates. The slope of front media-accelerating face of the blade portion also gradually increases moving outwardly along the intermediate blade portion, then to and along the peripheral edge portion thereof. The blade portions have increasing slope to accelerate the media more axially, and less radially, as the impeller rotates.

In a preferred aspect of the invention blade portion has leading and trailing edge portions which each have an elongated forwardly extended peripheral portion. The forwardly extending peripheral portions culminate in a tip portion which is preferably bulbuous, to facilitate efficient penetration of the media by the blade portion.

Various other objects, advantages and features of this invention will become apparent to those skilled in the art from the following description in conjunction with the accompanying drawings.

FIGURES OF THE INVENTION

Figure 1:
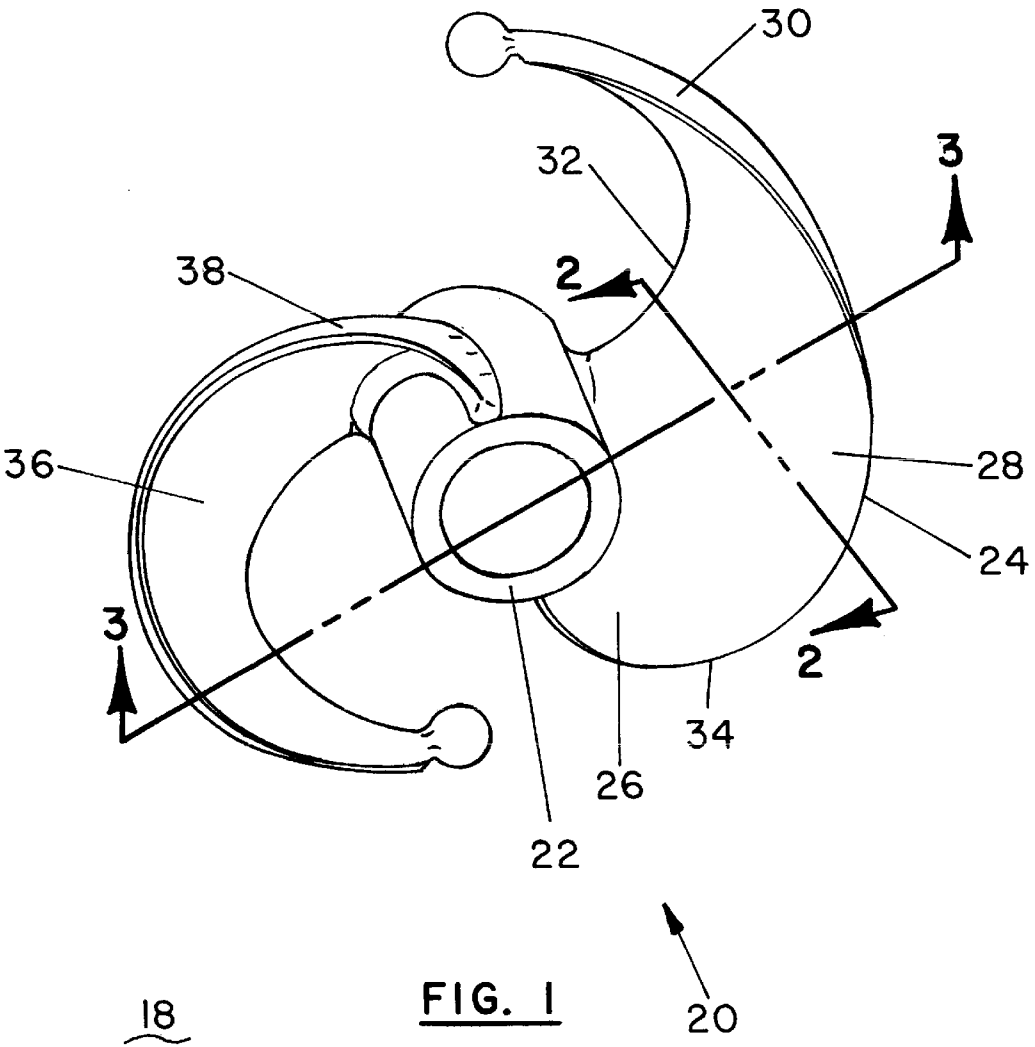
FIG. 1 is a perspective view of an improved impeller.

The following is a discussion and description of the preferred, specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and,more particularly to FIG. 1 we have a perspective view of an improved impeller 20. Within this application and the claims thereof, impeller is defined to include a propeller. The impeller 20, for rotation in a media 18, is of the type having a central hub 22, an inclined blade portion 24 having an inner radial edge portion 26 attached to the central hub 22, an intermediate blade portion 28 adjoined to the inner radial edge portion 26 on one side, a peripheral edge portion 30 attached to and extending outwardly from the central portion 28, a leading edge portion 32, a trailing edge portion 34, a front media-accelerating face 36, and a rear face 38. The improvement, not found in a conventional impeller 20 comprises the blade portion 24 having a media-accelerating front face 36 and substantially varying slopes which increase from the leading edge portion 32 to the trailing edge portion 34 of the media-accelerating front face 36 of the impeller 20. Accordingly the front media-acelerating face 36 of the blade portion is concave. The increasingly sloped blade portion 24 facilitates a gradual acceleration of the media 18 as the impeller 20 rotates.

Additionally, the slope of front media-accelerating face 36 of the blade portion 24 gradually increases moving outwardly along the intermediate blade portion 28, from the hub 22 to the peripheral edge portion 30 thereof. The blade portions 28,30 have increasing slope to accelerate the media 18 more axially, and less radially, as the impeller 20 rotates.

Figure 2:
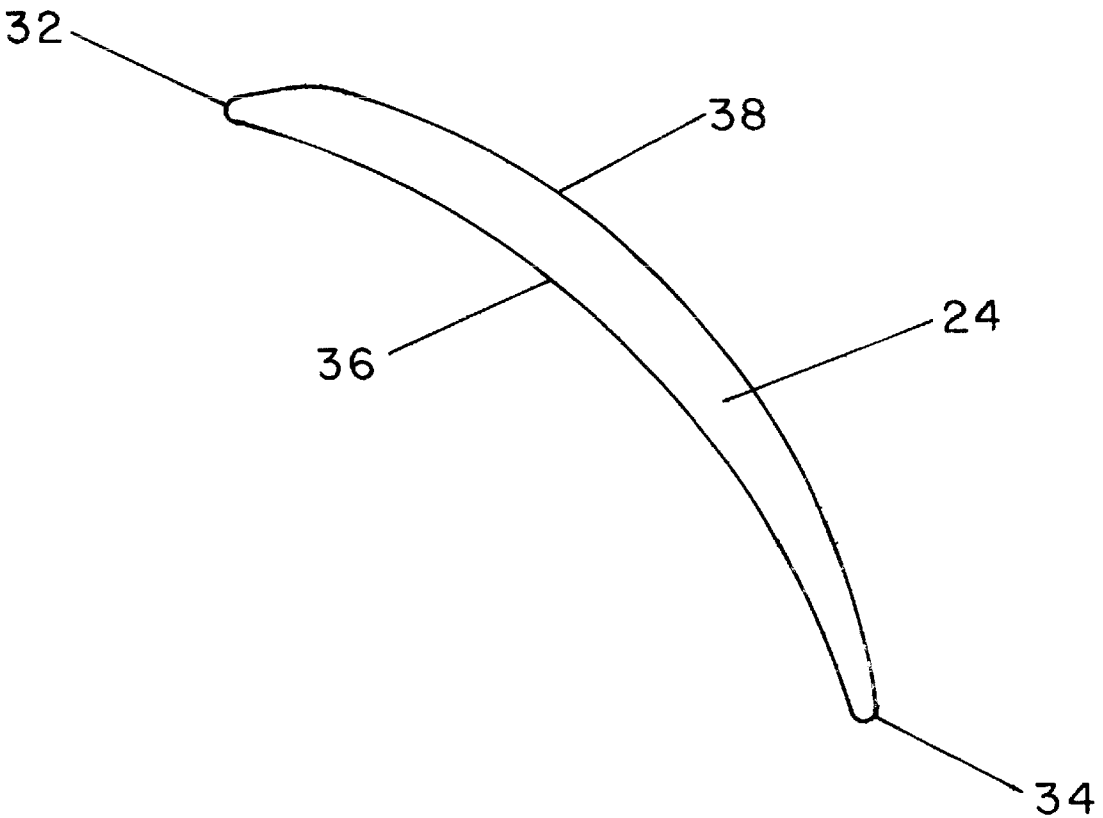
FIG. 2 is a cross sectional view of the blade portion as cut and viewed along line 2—2 on FIG. 1.

FIG. 2 is a cross sectional view of the blade portion 24 as cut and viewed along line 2—2 on FIG. 1. The rear face portion 38 of the blade portion 24 is differently sloped than the front media-accelerating face portion 36 of the blade portion 24, said front face portion 36 is sloped so that a cross section from a leading edge portion 32 through a trailing edge portion 34 centrally increases in thickness. The rear face portion 38 is designed to facilitate laminar flow inward and down across the rear of the blade portion 24 and push the blade portion 24 in the direction of rotation. In the most preferred embodiment of the invention there are two blade portions 24.

Figure 3:
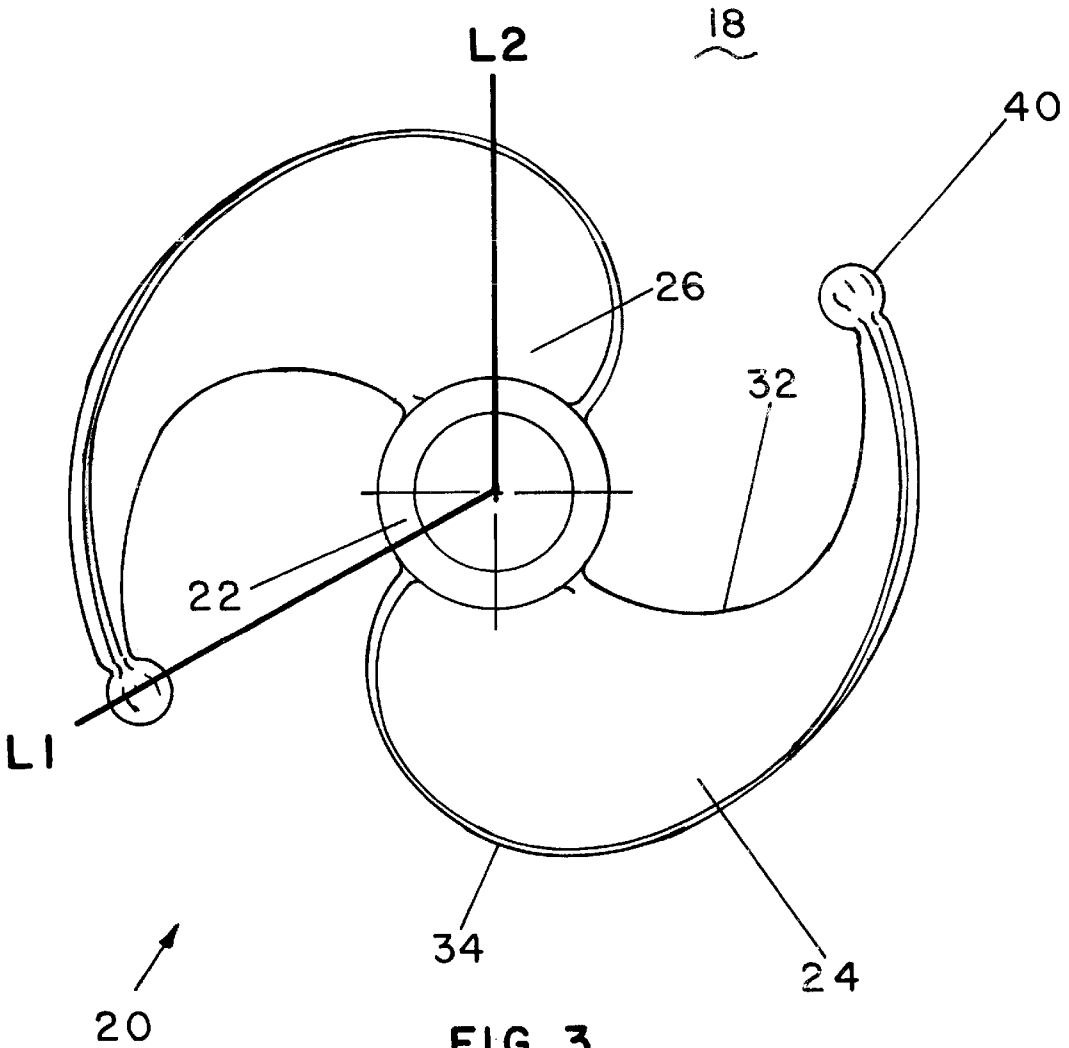
FIG. 3 is a rear view of the impeller shown in FIG. 1 as viewed along line 3—3 therein.

FIG. 3 is a rear view of the impeller 20 shown in FIG. 1 as viewed along line 3—3 therein. FIG. 3 best shows the blade portion 24 having leading and trailing edge portions 32,34 each having an elongated forwardly extended peripheral portion, said forwardly extending peripheral portions culminating in a bulbuous tip portion 40. Most preferably the tip portion 40 is bulbuous to facilitate efficient penetration of the media 18 by the blade portion 24.

The leading edge portion 32 of the blade portion 24 generally comprises a helix spiralling out from the hub 22 to the bulbuous tip portion 40. The trailing edge portion 34 of the blade portion 24 also generally comprises a helix spiralling out from the hub 22 to a circumference of the impeller 20, and then therealong to the bulbuous tip portion 40. In this preferred embodiment of the invention there are two blade portions 24.

Most preferably, the impeller 20 is designed so that a radial line L1 drawn through the bulbuous tip portion 40 generally precedes a radial line L2 drawn through a median point of attachment of the inner radial edge portion 26 to the hub 22 by 120 degrees.

While the invention has been described with preferred specific embodiments thereof, it will be understood that this description is intended to illustrate and not to limit the scope of the invention, which is defined by the following claims.

I claim:

1. In an impeller for rotation in a media of the type having a central hub, an inclined blade portion having an inner radial edge portion attached to the central hub, an intermediate blade portion adjoined to the inner radial edge portion on one side, a peripheral edge portion attached to and extending outwardly from the central portion, a leading edge portion, a trailing edge portion, a front face, and a rear face, the improvement comprising:

said blade portion having a media-accelerating front face and a substantially varying slopes which increase from the leading to the trailing edge portions of the media-accelerating front face of the impeller, so that the front media-accelerating face of the blade portion is concave, to facilitate a gradual acceleration of the media as the impeller rotates wherein said blade portion has a tip portion that is bulbous.

2. An impeller as in claim 1 wherein the slope of the front media-accelerating face of the blade portion increases moving outwardly along the intermediate blade portion, from the hub to the peripheral edge portion thereof, said blade portion having increasing slope to accelerate the media more axially, and less radially, as the impeller rotates.

3. An impeller as in claim 2 wherein the rear face portion of the blade portion is differently sloped than the front media-accelerating face portion thereof, said face portions being sloped so that a cross section from a leading edge portion through a trailing edge portion of the blade portion centrally increases in thickness.

4. An impeller as in claim 2 wherein there are two place portions.

5. In an impeller for rotation in a media of the type having a central hub, an inclined blade potion having an inner radial edge portion attached to the central hub, an intermediate blade portion adjoined to the inner radial edge portion on one side, a peripheral edge portion attached to and extending outwardly from the central portion, a leading edge portion, a trailing edge portion, a front face, and a rear face, the improvement comprising:

said blade portion having a media-accelerating front face having leading and trailing edge portions each having an elongated forwardly extended peripheral portion, said forwardly extending peripheral portions culminating in a tip portion, to facilitate efficient penetration of the media by the blade portion wherein the leading edge portion of the blade portion generally comprises a helix spiraling out from the hub to the tip portion.

6. An impeller as in claim 5 wherein the tip portion of said blade portion is bulbous.

7. An impeller as in claim 6 wherein the leading edge portion of the blade portion generally comprises a helix spiraling out from the hub to the bulbous tip portion.

8. An impeller as in claim 7 wherein the trailing edge portion of the blade portion generally comprises a helix spiraling out from the hub to a circumference of the impeller, then therealong to the bulbous tip portion.

9. An impeller as in claim 5 wherein the trailing edge portion of the blade portion generally comprises a helix spiraling out from the hub to a circumference of the impeller, ten therealong to the tip portion.

10. An impeller as in claim 5 wherein there are two blade portions.

11. An impeller as in claim 5 wherein the rear face portion of the blade portion is differently sloped than the front media-accelerating face portion thereof, said face portions being sloped so that a cross section from a leading edge portion through a trailing edge portion of the blade portion centrally increases in thickness.

12. An impeller as in claim 5 wherein a radial line drawn through the tip portion precedes a radial line drawn through a median point of attachment of the inner radial edge portion to the hub by more than 10 degrees.

13. An impeller as in claim 12, wherein a radial line drawn through the tip portion precedes a radial line drawn through a median point of attachment of the inner radial edge portion to the hub by 120 degrees plus or minus 90 degrees.

14. An impeller as in claim 13 wherein a radial line drawn through the tip portion precedes a radial line drawn through a median point of attachment of the inner radial edge portion to the hub by 120 degrees plus or minus 60 degrees.

15. An impeller as in claim 14 wherein a radial line drawn through the tip portion precedes a radial line drawn through a median point of attachment of the inner radial edge portion to the hub by 120 degrees plus or minus 45 degrees.

16. An impeller as in claim 15 wherein a radial line drawn through the tip portion precedes a radial line drawn through a median point of attachment of the inner radial edge portion to the hub by 120 degrees plus or minus 30 degrees.

17. An impeller as in claim 16 wherein a radial line drawn through the tip portion precedes a radial line drawn through a median point of attachment of the inner radial edge portion to the hub by 120 degrees plus or minus 60 degrees.

18. An impeller as in claim 17 wherein a radial line drawn through the tip portion precedes a radial line drawn through a median point of attachment of the inner radial edge portion to the hub by generally 120 degrees.

* * * * *